US010174394B2

(12) United States Patent
Fukada

(10) Patent No.: US 10,174,394 B2
(45) Date of Patent: Jan. 8, 2019

(54) STEEL FOR BLADES AND METHOD FOR PRODUCING THE SAME

(71) Applicant: HITACHI METALS, LTD., Tokyo (JP)

(72) Inventor: Shinichiro Fukada, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 549 days.

(21) Appl. No.: 14/780,165

(22) PCT Filed: Mar. 28, 2014

(86) PCT No.: PCT/JP2014/059119
§ 371 (c)(1),
(2) Date: Sep. 25, 2015

(87) PCT Pub. No.: WO2014/162996
PCT Pub. Date: Oct. 9, 2014

(65) Prior Publication Data

US 2016/0040264 A1 Feb. 11, 2016

(30) Foreign Application Priority Data

Apr. 1, 2013 (JP) ..... 2013-075839

(51) Int. Cl.

| | |
|---|---|
| ***C21D 9/20*** | (2006.01) |
| ***C21D 9/46*** | (2006.01) |
| ***C22C 38/18*** | (2006.01) |
| ***C22C 38/02*** | (2006.01) |
| ***C22C 38/04*** | (2006.01) |
| ***C21D 6/00*** | (2006.01) |
| ***C21D 8/02*** | (2006.01) |
| ***C22C 38/00*** | (2006.01) |

(52) U.S. Cl.
CPC ..... *C21D 9/20* (2013.01); *C21D 6/002* (2013.01); *C21D 6/004* (2013.01); *C21D 6/005* (2013.01); *C21D 6/008* (2013.01); *C21D 8/0236* (2013.01); *C21D 8/0268* (2013.01); *C21D 9/46* (2013.01); *C22C 38/002* (2013.01); *C22C 38/02* (2013.01); *C22C 38/04* (2013.01); *C22C 38/18* (2013.01); *C21D 2211/004* (2013.01); *C21D 2211/005* (2013.01)

(58) Field of Classification Search
CPC ..... C21D 9/20; C21D 6/004; C21D 6/005; C21D 6/008; C21D 8/0236; C21D 8/0268; C22C 38/04; C22C 38/02; C22C 38/18; C22C 38/002
See application file for complete search history.

(56) References Cited

U.S. PATENT DOCUMENTS

| | | | | |
|---|---|---|---|---|
| 4,021,272 | A | 5/1977 | Asai et al. | |
| 5,305,526 | A | 4/1994 | Althaus | |
| 6,273,973 | B1 | 8/2001 | Parayil et al. | |
| 2006/0065327 | A1* | 3/2006 | Buck | C21D 6/004 148/325 |
| 2012/0237390 | A1 | 9/2012 | Jeong et al. | |
| 2012/0321501 | A1 | 10/2012 | Chae et al. | |

FOREIGN PATENT DOCUMENTS

| | | | |
|---|---|---|---|
| EP | 0 485 641 | A1 | 5/1992 |
| GB | 2 258 469 | | 2/1993 |
| JP | 54-121218 | A | 9/1979 |
| JP | 05-039547 | | 2/1993 |
| JP | H05-277264 | A | 10/1993 |
| JP | 06-145907 | | 5/1994 |
| JP | 2002212679 | A | 7/2002 |
| JP | 3354163 | B2 | 12/2002 |
| JP | 2003515672 | A | 5/2003 |
| JP | 2007224405 | A | 9/2007 |
| JP | 2009-270196 | | 11/2009 |
| KR | 10-2013-0019655 | | 2/2013 |

OTHER PUBLICATIONS

English Abstract and English Machine Translation of Kumagai et al. (JP 05-039547) (Feb. 19, 1993).*
International Search Report corresponding to Japanese Application No. PCT/JP2014/059119 dated Jun. 24, 2014.
International Search Report corresponding to Japanese Application No. PCT/JP2014/059120 dated Jun. 24, 2014.
Extended European Search Report corresponding to European Patent Application No. 14778051.4 (6 pages) (dated Oct. 21, 2016).
Kunitake, Tatsuro "Prediction of Ac1, Ac3 and Ms Temperatures of Steel by Empirical Formulas" Journal of Japan Society of Heat Treatment, 41:164-169 (2001) (translation of abstract only).

* cited by examiner

*Primary Examiner* — Jessee R Roe
(74) *Attorney, Agent, or Firm* — Myers Bigel, P.A.

(57) ABSTRACT

An object of the present invention is to provide steel for blades with a significantly improved carbide concentration and a method for producing the same. The steel for blades has a metal composition consisting of, by mass, 0.55% to 0.8% C, not more than 1.0% Si, not more than 1.0% Mn, 12.0% to 14.0% Cr, and the balance of Fe with inevitable impurities, wherein the number of carbides in a ferrite structure of the steel for blades is 600 to 1,000 per an area of 100 $\mu m^2$.

5 Claims, 2 Drawing Sheets

STEEL FOR BLADES AND METHOD FOR PRODUCING THE SAME

RELATED APPLICATIONS

This application is a 35 U.S.C. § 371 national phase application of PCT Application PCT/JP2014/059119 filed Mar. 28, 2014 which claims priority to Japanese Application No. 2013-075839 filed Apr. 1, 2013. The entire contents of each are incorporated herein by reference in its entirety.

TECHNICAL FIELD

The present invention is related to steel for blades, which may be used for razors and the like, and to a method for producing the same.

BACKGROUND ART

Currently, martensitic stainless steel containing 12.0% to 14.0% by mass of Cr has been generally and widely used as steel for blades, which is used as razors and the like. The martensitic stainless steel is hardened to 620 HV to 650 HV, which is a range of hardness for razor blades, by heat treatments including quenching and tempering. The martensitic stainless steel is superior to high carbon steel in terms of rust prevention and corrosion resistance.

The martensitic stainless steel for razors is usually produced by a combination of hot rolling, cold rolling, and annealing, to be supplied to a subsequent process as razor steel in the form of a strip. In the subsequent process, after being subjected to perforating, the martensitic stainless steel undergoes heat treatments including quenching and tempering by a continuous furnace and then undergoes blade edging and surface finishing to be produced as a final product.

The metal structure after the martensitic stainless steel is annealed is in a state in which carbides are dispersed in the ferrite structure. The granularity and the state of distribution of the carbides greatly influence the properties of the martensitic stainless steel as a razor blade having undergone heat treatment.

A large number of proposals have been made for stainless steel for razors. Among others, JP 3354163 B (Patent Document 1) by the applicant of the present invention may be mentioned as an invention that significantly improves quenchability by increasing the number of carbides. This Patent Document 1 discloses stainless steel for razors with excellent short-time quenchability consisting of, by mass, 0.55% to 0.73% C, not more than 1% Si, not more than 1% Mn, 12% to 14% Cr, and the balance of Fe with impurities and having a carbide concentration of 140 to 600 carbides/100 $\mu m^2$ in a state of annealing by a continuous furnace. Note that the concentration of carbides shown in Patent Document 1 was obtained by measuring in a strip of stainless steel for razors prior to or during cold rolling in a state in which the steel is inserted into a continuous furnace set to a temperature of or higher than the Ac1 transformation temperature of the steel to be annealed.

CITATION LIST

Patent Document

[Patent Document 1] JP 3354163 B

SUMMARY OF INVENTION

Technical Problem

The stainless steel for razors disclosed in Patent Document 1 has implemented excellent quenchability by significantly increasing the carbide concentration. If the above-described carbide concentration disclosed in Patent Document 1 can be further improved, further improved excellent quenchability can be obtained.

An object of the present invention is to provide steel for blades with a significantly improved carbide concentration and a method for producing the same.

Solution to Problem

The inventor of the present invention has discovered that significant improvement of the concentration of carbides can be realized and extremely superior quenchability can be achieved by annealing a material to be cold rolled having a specific metal structure at an Ac1 transformation point or higher and subsequently performing cold rolling and annealing at the Ac1 transformation point or higher for multiple times, and thereby completed the present invention.

According to an aspect of the present invention, there is provided steel for blades having a metal composition consisting of, by mass, 0.55% to 0.8% C, not more than 1.0% Si, not more than 1.0% Mn, 12.0% to 14.0% Cr, and the balance of Fe with inevitable impurities, wherein the number of carbides in a ferrite structure of the steel for blades is between 600 and 1,000 per an area of 100 $\mu m^2$.

According to another aspect of the present invention, there is provided a method for producing steel for blades having a metal composition consisting of, by mass, 0.55% to 0.8% C, not more than 1.0% Si, not more than 1.0% Mn, 12.0% to 14.0% Cr, and the balance of Fe with inevitable impurities, the method comprising: a continuous annealing step for continuously annealing a material to be cold rolled for 5 to 30 minutes, the material having been heated to at least an Ac1 transformation point of the metal composition; and a cold rolling step for cold rolling the material subjected to the continuous annealing step, wherein the continuous annealing step and the cold rolling step after the continuous annealing step are repeated at least twice.

Advantageous Effects of Invention

According to the present invention, an excellent quenchability can be implemented because the carbide concentration in a ferrite structure of steel for blades can be improved.

DESCRIPTION OF EMBODIMENTS

Figure 1:
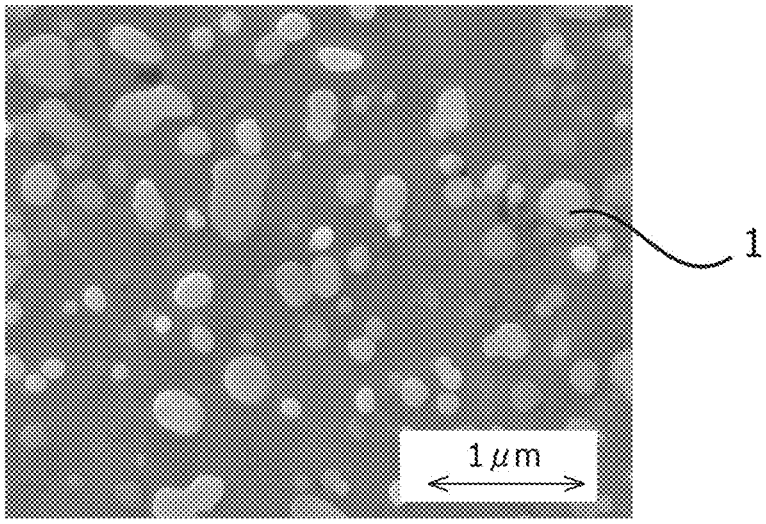
FIG. 1 is an electron microscope photograph showing a cross sectional view of a state of carbides in the steel for blades of Example 1.

The reason a metal composition of steel for blades according to the present invention is limited will be described.

To begin with, the content of carbon (C) is 0.55% to 0.8% by mass. C is an element important not only for yielding the carbide concentration necessary for the present invention but also for determining the hardness of martensite prepared by quenching by dissolving in a matrix from carbides at a quenching austenitizing temperature. It is necessary that the content of C be more than 0.55% by mass in order to obtain the hardness sufficiently high for steel for blades and to obtain the concentration of carbides in the ferrite structure having 6 carbides/$\mu m^2$ to 10 carbides/$m^2$. Furthermore, in martensite stainless steel, large eutectic carbides crystallize during solidification according to the balance between the content of C and Cr. If such large carbides are included in steel for blades, such as a razor substitute edge material, in particular, with a thickness of about 0.1 mm and a sharp blade, blade chipping may occur. To prevent this, the upper limit of the content of C is 0.8% by mass considering the balance with the content of Cr. The lower limit of the content of C is preferably 0.60% by mass, and more preferably 0.63% by mass. The upper limit of the content of C is preferably 0.78% by mass, and more preferably 0.75% by mass. These limits are determined to more securely obtain the effect of C.

The content of silicon (Si) is not more than 1.0% by mass. Si is an element used as a deoxidant in refining of steel for blades and also for preventing dehardening during low-temperature tempering as a solid solution in steel. If an excessive amount of Si is added, Si may remain in steel for blades as hard inclusion such as $SiO_2$ and may cause chipping of blades and spot rust, and to prevent this, the upper limit of the content of Si is 1.0% by mass. In order to securely obtain the effect of Si for resisting dehardening that may occur during low-temperature tempering and to prevent generation of hard inclusions, the content of Si is preferably 0.1% to 0.7% by mass. Furthermore, the lower limit of the content of Si is preferably 0.15% by mass, and more preferably 0.5% by mass. These limits of Si are determined to more reliably yield the effects of Si.

The content of manganese (Mn) is not more than 1.0% by mass. Similarly to Si, Mn can be used as a deoxidant in refining of steel for blades. If the content of Mn exceeds 1.0% by mass, the hot workability may be degraded, and to prevent this, the content of Mn is not more than 1.0% by mass. Note that if Mn is used as a deoxidant, not a small amount of Mn remains in the cutting steel. Accordingly, the lower limit of Mn is higher than 0% by mass. A preferable range of the content of Mn is 0.1% by mass to 0.9% by mass. These limits are determined to more reliably yield the effects of Mn.

The content of chrome (Cr) is 12.0% to 14.0% by mass. Cr is an element used for maintaining excellent resistance to corrosion of steel for blades, and forms a carbide with C. Cr is an element important for obtaining Cr carbide that is necessary for controlling the concentration of carbides in a ferrite structure to be 6 carbides/$\mu m^2$ to 10 carbides/$\mu m^2$. In order to obtain the above-described effect of Cr, at least 12.0% by mass of Cr is necessary. On the other hand, if the content of Cr exceeds 14.0% by mass, the amount of crystallized eutectic carbides may increase, which may cause blades to chip when the steel for blades is used for razors, for example. To prevent this, the content of Cr is in a range of 12.0% by mass to 14.0% by mass. In order to more reliably obtain the above-described effect of adding Cr, the lower limit of Cr is 12.5% by mass, and the upper limit of Cr is preferably 13.5% by mass. These limits are determined to more securely yield the effects of Cr.

The steel for blades according to the present embodiment is constituted by the elements described above, and the balance if of Fe and inevitable impurities. The inevitable impurities typically include P, S, Ni, Cu, Al, Ti, N, and O, and the contents of these elements are in the following range, respectively. If the contents of these elements are in the following ranges, the effects of the elements described above are not inhibited.

P≤0.03% by mass, S≤0.005% by mass, Ni≤1.0% by mass, Cu≤0.5% by mass, Al≤0.1% by mass, Ti≤0.1% by mass, N≤0.05% by mass, and O≤0.05% by mass.

Next, a metal structure will be described below, which has the most important characteristic of the present invention. As the metal structure of steel for blades, the concentration of carbides in a ferrite structure is more than 6 carbides/$\mu m^2$ and not more than 10 carbides/$\mu m^2$. The above-described metal structure provides a metal structure as a ferrite structure obtained after final annealing and cold rolling. In an annealed state, the steel for blades according to the present invention takes a form in which carbides are dispersed in the ferrite structure. This ferrite structure is subjected to quenching to prepare martensitic stainless steel.

If the steel for blades according to the present invention is used for razors, for example, the steel for blades is subjected to quenching and tempering to prepare martensitic stainless steel. In this process, in order to increase the productivity by increasing the plate passing speed during the hardening and to readily increase the hardness of the steel for blades at the same plate passing speed as that in the conventional method, it is necessary that the carbides immediately and sufficiently form a solid solution and that the carbon content of the matrix be increased. If fine carbides are dispersed in the ferrite structure at a high concentration in the annealed state before the quenching and the tempering, the carbides are immediately dissolved in iron by the quenching. As a result, the productivity can be improved and the hardness of the steel for blades can be increased.

In the present invention, the number of carbides in the ferrite structure of the steel for blades is from 600 to 1,000 in an area 100 $\mu m^2$. By performing the following production method of the present invention, the number of carbides in the ferrite structure can be increased to be more than 600 in an area of 100 $\mu m^2$. The upper limit of the number of the carbides would hardly become more than 1,000 even if the following production method of the present invention is applied. If it is to be attempted to obtain more than 1,000 carbides in an area of 100 $\mu m^2$, it is necessary to change the content of C and the content of Cr. In this case, coarse eutectic carbide may be formed during dissolution caused by the quenching or the like, which may cause chipping of blades. To prevent this, the upper limit of the number of the carbides is set at 1,000.

Meanwhile, according to Patent Document 1, it is recognized that if the concentration of carbides in an annealed state by a continuous furnace exceeds 600 carbides/100 $\mu m^2$, i.e., 6 carbides/$\mu m^2$, cold rolling may be very labor-intensive, and the probability of a steel strip breaking during cold rolling may increase. However, it has been newly recognized that according to the following production method of the present invention, if the concentration of the carbides in the ferrite structure becomes so high that it is more than 600 in an area of 100 $\mu m^2$, the size of each carbide is reduced, and thereby propagation of cracks starting from the carbides is decreased, and accordingly, there will not be any particular problem due to a broken steel strip.

In the present invention, the carbide concentration is determined by a method in which an area of 100 $\mu m^2$ of the metal structure is observed and determined by using an electron microscope. Specifically, the measurement is performed by a method in which the image observed by the electron microscope is subjected to image analysis and the number of carbides and the circle equivalent diameter of the respective carbides are determined. In this measurement, if the accelerating voltage of the electron microscope becomes excessively high, the carbides existing on the matrix may be possibly detected. In contrast, if the accelerating voltage of the electron microscope becomes excessively low, the resolution may degrade, and accordingly, the accelerating voltage may be set at 15 kv for observation. It is preferable that the region to be observed be 100 $\mu m^2$. This is because it is sufficient to measure the concentration of carbides in an area of 100 $\mu m^2$ because if the concentration of carbides is measured in an area exceeding 100 $\mu m^2$, the measurement result would not be greatly different.

The maximum size of the carbides is preferably 0.6 μm. In the present invention, the concentration of carbides is from 600 to 1,000 in the observation region of 100 $\mu m^2$. Accordingly, the respective carbides are fine. If the size of the carbides becomes excessively large, the sharpness of the edge of a razor may decrease, and it becomes less easy to increase the hardness of the steel for blades. Accordingly, the maximum size of the carbides is set at 0.6 μm. If the maximum size of the carbides is 0.6 μm or less, the time for quenching for producing blades can be shortened, which can improve the productivity of producing blades. In addition, if the maximum size of the carbides is 0.6 μm or less, the performance of the produced blades may not become irregular. The maximum size of the carbides is preferably 0.55 μm or less, and more preferably 0.50 μm or less. This is because if the maximum size of the carbides is controlled as described above, the sharpness of the edge can be increased more.

The average size of the carbides is preferably 0.05 μm to 0.3 μm. This is because in order to obtain sufficiently high quenching performance within a short time, it is preferable if the respective carbides be as fine as possible. Accordingly, in the present invention, the average size of the carbides is set at 0.05 μm to 0.3 μm.

For observation and the measurement of the size and the average size of the carbides, a scanning electron microscope was used. The accelerating voltage was set at 15 kv, an image observed in an observation region of 100 $\mu m^2$ by using the electron microscope was subjected to image analysis, the number of the carbides and the circle equivalent diameter (peripheral length circle equivalent diameter) of the respective carbides were determined, and thereby the concentration of carbides and the size of the carbides were determined. In the present invention, the maximum size of the carbides refers to a maximum value of the circle equivalent diameter observed for the carbides in the region of 100 $\mu m^2$. The average size is an average value of the circle equivalent diameter of all the carbides observed in the observation region of 100 $\mu m^2$.

Conventionally, it has been recognized that if the number of the carbides in a ferrite structure of steel for blades is more than 600 in an area of 100 $\mu m^2$, cold rolling may be very labor-intensive and there may be a high probability of a steel strip breaking during the cold rolling. However, by using the carbides in the above-described form, the concentration of the carbides can be increased with a low probability of breakage of the strip steel for blades.

Next, an example of the production method of the present invention will be described. For a material, a hot rolled material having a metal structure constituted by 0.55% by mass to 0.8% by mass of C, 1.0% by mass or less of Si, 1.0% by mass or less of Mn, 12.0% by mass to 14.0% by mass of Cr, the balance of Fe, and inevitable impurities is used as a cold rolling material. The cold rolling material is heated to a temperature higher than the Ac1 transformation temperature, and subsequently, continuous annealing at a temperature higher than the Ac1 transformation temperature is performed on the cold rolling material for 5 to 30 minutes (continuous annealing step). After the continuous annealing step, the cold rolling material is cold-rolled (cold rolling step). The continuous annealing step and the cold rolling step after the continuous annealing step are repeated at least twice. The cold rolling material is previously subjected to continuous annealing at the Ac1 transformation point or higher and the continuous annealing at the Ac1 transformation point or higher is performed during the plurality of times of the cold rolling step, and thereby the concentration of carbides in the ferrite structure can be controlled to be 6 carbides/$\mu m^2$ to 10 carbides/$m^2$. In order to control the maximum size of the carbides to be 0.6 μm or less and the average size of the carbides to range from 0.05 μm to 0.3 μm, for example, it is more reliable to perform one or more times of continuous annealing at or above the Ac1 transformation point performed during the cold rolling step, i.e., the continuous annealing step and the cold rolling step after the continuous annealing step are repeated at least twice.

The upper limit of the number of times of the continuous annealing performed during the multiple times of cold rolling step is not particularly limited; however, it is sufficient that the upper limit of the number of times of the continuous annealing be five times because if the continuous annealing performed during the cold rolling step is performed five times at most, the concentration of carbides in the ferrite structure becomes more than 6 carbides/$\mu m^2$ and 10 carbides/$\mu m^2$ or less. For the continuous annealing, the steel strip is passed through an annealing furnace that has been heated to a specific temperature for the annealing. In this step, the specific temperature is the Ac1 transformation temperature of the steel for blades or higher. If the continuous annealing time is excessively short, the form of the carbides in which the concentration of carbides in the ferrite structure is 6 carbides/$\mu m^2$ to 10 carbides/$\mu m^2$ cannot be obtained, and therefore the lower limit of the continuous annealing time is 5 minutes. Furthermore, if the continuous annealing time is set to 30 minutes, the concentration of carbides in the ferrite structure becomes 6 carbides/$\mu m^2$ to 10 carbides/$\mu m^2$. If the continuous annealing time exceeds 30 minutes, the effect of refining the carbides would not increase, and there would be a risk of reduced productivity due to prolonged annealing time, and accordingly, the upper limit of the annealing time is 30 minutes.

The annealing time of the continuous annealing performed during the multiple times of cold rolling step is preferably is 10 minutes or less. This is because by performing the annealing for 10 minutes or less, the effect of refining the carbides can be sufficiently obtained.

EXAMPLES

The present invention will be more specifically described with reference to Examples and Conventional Examples. However, the present invention is not limited to the following Examples in any way.

Example 1

The alloy composition and the thickness of the hot-rolled material were determined with reference to the example described in Patent Document 1. Table 1 illustrates the metal composition of the hot-rolled material. The thickness of the hot-rolled material was 1.7 mm. Of the metal compositions shown in Table 1, "Conventional Example" is No. C steel having the highest carbide concentration among the steel described in the examples of Patent Document 1. Example 1 of the present invention was intended as steel having the same metal composition as that of No. C steel.

TABLE 1

(% by mass)

| C | Si | Mn | Cr | Balance | Note |
|---|---|---|---|---|---|
| 0.68 | 0.28 | 0.74 | 13.26 | Fe and inevitable impurities | Example 1 |
| 0.66 | 0.63 | 0.75 | 13.59 | Same as above | Conventional Example |

The hot-rolled material according to Example 1 was used as the cold rolling material, and after the cold rolling material was heated to 850° C., the material was fed into a continuous furnace having a heating zone and continuous annealing for 10 minutes was performed. Note that the Ac1 transformation point for steel for blades shown in Table 1 was 800° C. for both Example 1 and the Conventional Example.

Next, the oxide layer previously formed on the surface was removed to perform cold rolling. The first cold rolling was performed so that the rolling ratio would be 50% or more. Subsequently, the material was further heated to 850° C., continuous annealing was performed at 850° C. for 10 minutes, and the second cold rolling was performed so that the rolling ratio would be 50% or higher. The material was further heated to 850° C., continuous annealing was performed at 850° C. for 10 minutes, and then the last cold rolling was performed so that the thickness of the product would become 0.1 mm to produce the steel for blades of Example 1. No failures such as cracked material and the like occurred during the cold rolling.

The production method of Conventional Example will be described. A hot-rolled material having the metal composition shown in Table 1 and a thickness of 1.7 mm was fed into a continuous furnace having a heating zone set at 850° C.×20 minutes, annealing was performed therein, and then steps of cold rolling, annealing at 780° C.×5 minutes, cold rolling, annealing at 780° C.×5 minutes, and cold rolling were performed to produce steel for blades with the thickness of 0.1 mm.

Test pieces for observing the concentration of the carbides were sampled from the steel for blades of Example 1 and the steel for blades of the Conventional Example obtained as described above, and the carbide concentration was measured by using an electron microscope. The observation surface was ground by using emery paper into a flat surface, and then was subjected to electrolytic polishing and corrosion with Nital solution to expose the carbides. A scanning electron microscope was used for the observation of the carbides of the test pieces. For the measurement condition, the accelerating voltage was 15 kv, and the image observed in the observation region of 100 $\mu m^2$ by using the electron microscope was subjected to image analysis. The number of the carbides and the circle equivalent diameter of the respective carbides were determined according to the results of the image analysis, and the concentration of the carbides, the size of the carbides, and the average size of the carbides were determined.

FIG. 1 illustrates an electron microscope photograph of the form of the carbide observed by using the steel for blades according to Example 1. The concentration of the carbides according to Example 1 was very high and the size of the respective carbides was fine, and thus the magnification of the electron microscope photograph shown in FIG. 1 is 30,000×. As shown in FIG. 1, it is known that fine carbides 1 of 0.5 μm at the maximum were homogeneously dispersed. The composition of the carbides was determined by using an energy dispersive X-ray analyzer, and as a result, the carbides were a Cr carbide.

Figure 4:
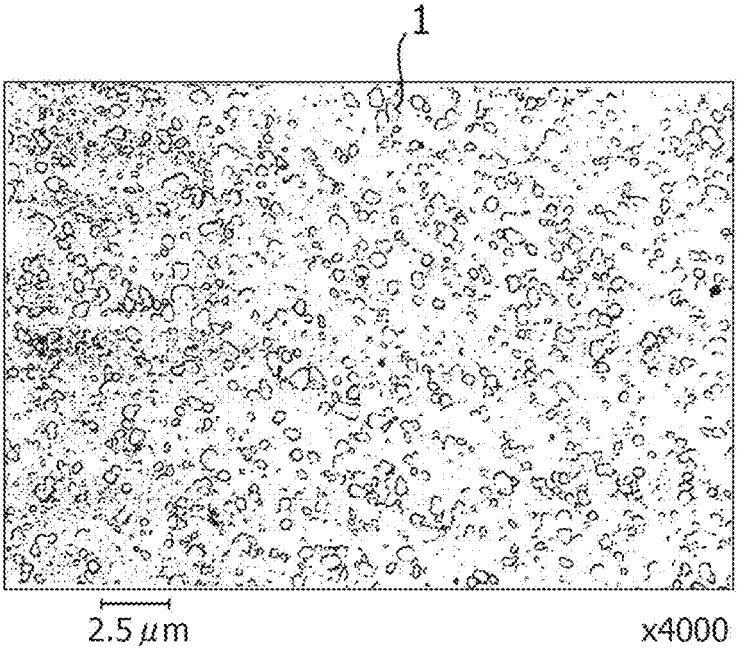
FIG. 4 is an electron microscope photograph showing a cross sectional view of a state of carbides in the steel for blades of a Conventional Example.

FIG. 4 illustrates an electron microscope photograph of the form of the carbide observed by using the steel for blades according to the Conventional Example. The magnification is 4,000×. In FIG. 4, carbides of a maximum size of 1 μm were observed. It can be known that the carbide concentration was lower than that shown in FIG. 1.

Table 2 shows the carbide concentration of Example 1 and that of Conventional Example determined based on the number of the carbides in an area of 100 $\mu m^2$.

TABLE 2

| | Carbide concentration (number/100 $\mu m^2$) |
|---|---|
| Example 1 | 814 |
| Conventional Example | 560 |

As shown in Table 2, it can be known that in the steel for blades of Example 1, more than 800 carbides were obtained per 100 $\mu m^2$. As a result of the measurement, the maximum size of the carbides of Example 1 was 0.5 μm. As a result of the measurement, the average size of the carbides of Example 1 was 0.15 μm. For the steel for blades of the Conventional Example, the carbides having a maximum size of 1.0 μm were observed. A large number of carbides of more than 0.6 μm were also observed.

Examples 2 and 3

Next, tests were performed under heat treatment conditions different from those in Example 1. The alloy composition was the same as that in Example 1, and the thickness of the hot-rolled material was 1.7 mm, similarly to that in Example 1.

The same hot-rolled material as that in Example 1 was used as the starting material, the starting material was heated to 850° C., and then the material was fed into a continuous furnace having a heating zone, and continuous annealing was performed at 850° C. for 12 minutes to prepare a cold rolling material of Example 2. A material having been subjected to continuous annealing performed at 850° C. for 15 minutes was used as a cold rolling material of Example 3.

Next, the oxide layer previously formed on the surface was removed to perform cold rolling. The first cold rolling was performed so that the rolling ratio would become 50% or higher. Subsequently, the material was further heated to 850° C., continuous annealing was performed at 850° C. for 10 minutes, and the second cold rolling was performed so that the rolling ratio would be 50% or higher. The material was further heated to 850° C., continuous annealing was performed at 850° C. for 10 minutes, and then the last cold rolling was performed so that the thickness of the product would be 0.1 mm to produce the steel for blades of Examples 2 and 3. No failures such as cracked material and the like occurred during the cold rolling.

Test pieces for observing the concentration of the carbides were sampled from the steel for blades of Examples 2 and 3 and the steel for blades of the Conventional Example obtained as described above, and the carbide concentration was measured by using an electron microscope. The observation surface was ground by using emery paper into a flat surface, and then was subjected to electrolytic polishing and corrosion with Nital solution to expose the carbides. A scanning electron microscope was used for the observation of the carbides of the test pieces. For the measurement condition, the accelerating voltage was 15 kv, and the images observed in the observation region of 100 $\mu m^2$ by using the electron microscope were subjected to image analysis. The number of the carbides and the circle equivalent diameter of the respective carbides were determined according to the results of the image analysis, and the concentration of the carbides, the size of the carbides, and the average size of the carbides were determined.

Figure 2:
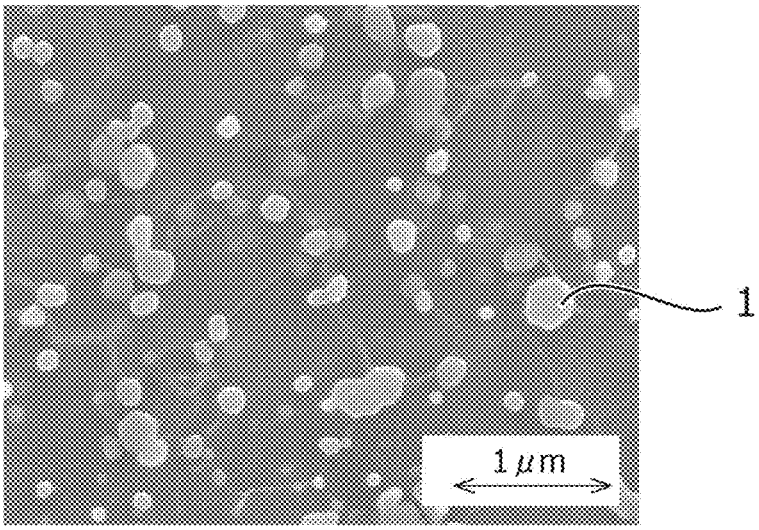
FIG. 2 is an electron microscope photograph showing a cross sectional view of a state of carbides in the steel for blades of Example 2.
Figure 3:
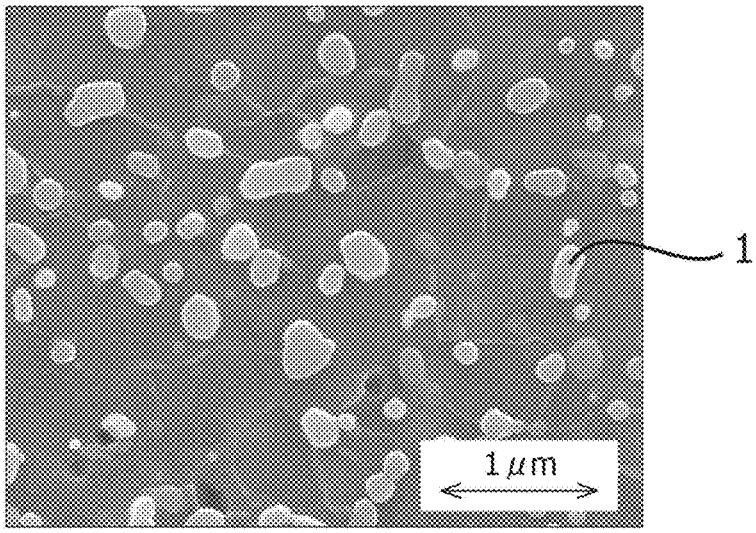
FIG. 3 is an electron microscope photograph showing a cross sectional view of a state of carbides in the steel for blades of Example 3.

FIG. 2 shows an electron microscope photograph of the form of the carbide observed by using the steel for blades according to Example 2. FIG. 3 shows an electron microscope photograph of the form of the carbide observed by using the steel for blades according to Example 3. The concentration of the carbides according to Examples 2 and 3 was very high, and the size of the respective carbides was fine, and thus, the magnification of the electron microscope photograph shown in FIGS. 2 and 3 is 30,000×, respectively. As shown in FIGS. 2 and 3, it is known that fine carbides 1 of 0.5 μm at the maximum were homogeneously dispersed. The composition of the carbides was determined by using an energy dispersive X-ray analyzer, and as a result, the carbides were a Cr carbide. Table 3 shows the concentration of the carbides of Example 2 and Example 3 determined based on the number of carbides in an area of 100 $\mu m^2$.

TABLE 3

| | Carbide concentration (number/100 $\mu m^2$) |
|---|---|
| Example 2 | 752 |
| Example 3 | 717 |

As shown in Table 3, it can be known that in the steel for blades of Examples 2 and 3, more than 700 carbides were obtained per 100 $\mu m^2$. As a result of the measurement, the maximum size of the carbides of both Examples 2 and 3 was 0.5 μm. As a result of the measurement, the average size of the carbides of both Examples 2 and 3 was 0.15 μm.

As described above, because more than 600 carbides exist in the region of 100 $\mu m^2$ of the steel for blades according to the present invention, it can be understood that the steel for blades according to the present invention has an excellent quenchability.

INDUSTRIAL APPLICABILITY

The steel for blades according to the present invention is optimal for use as steel for razors, and therefore, it is industriously useful. If the steel for blades is used for razors, it is preferable that the thickness of the steel for blades be 0.1 mm or less, similarly to the above-described Examples.

LIST OF REFERENCE SYMBOLS

1: Carbides

The invention claimed is:

1. Steel for blades having a metal composition consisting of, by mass, 0.55% to 0.8% C, not more than 1.0% Si, not more than 1.0% Mn, 12.0% to 14.0% Cr, and the balance of Fe with inevitable impurities, wherein the number of carbides in a ferrite structure of the steel for blades is 600 to 1,000 per an area of 100 $\mu m^2$, wherein an average size of the carbides is 0.05 μm to 0.3 μm.

2. The steel for blades according to claim 1, wherein a maximum size of the carbides is not more than 0.6 μm.

3. A method for producing steel for blades having a metal composition consisting of, by mass, 0.55% to 0.8% C, not more than 1.0% Si, not more than 1.0% Mn, 12.0% to 14.0% Cr, and the balance of Fe with inevitable impurities, the method comprising:

a continuous annealing step for continuously annealing a material to be cold rolled during 5 to 30 minutes, the material having been heated to at least an Ac1 transformation point of the metal composition; and a cold rolling step for cold rolling the material subjected to the continuous annealing step, wherein the continuous annealing step and the cold rolling step after the continuous annealing step are repeated at least twice.

4. The method for producing steel for blades according to claim 3, wherein a time of continuously annealing in the continuous annealing step performed between the cold rolling steps is not more than 15 minutes.

5. A method for producing steel for blades having a metal composition consisting of, by mass, 0.55% to 0.8% C, not more than 1.0% Si, not more than 1.0% Mn, 12.0% to 14.0% Cr, and the balance of Fe with inevitable impurities, characterized in that a material to be cold rolled for steel for blades is continuously annealed at a temperature of at least an Ac1 transformation point, is cold rolled multiple times and is continuously annealed between the cold rollings, the continuous annealing between the cold rollings being carried out at least once at a temperature of at least the Ac1 transformation point, so that the number of carbides in a ferrite structure of the steel for blades is 600 to 1,000 per an area of 100 $\mu m^2$.

* * * * *